US012252818B2

(12) United States Patent
Kozuka et al.

(10) Patent No.: US 12,252,818 B2
(45) Date of Patent: Mar. 18, 2025

(54) WOVEN FABRIC, METHOD FOR PRODUCING SAME, AND FIBER PRODUCT CONTAINING SAID WOVEN FABRIC

(71) Applicant: Asahi Kasei Kabushiki Kaisha, Tokyo (JP)

(72) Inventors: Kazunori Kozuka, Ishikawa (JP); Tomoya Onishi, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 647 days.

(21) Appl. No.: 17/424,008

(22) PCT Filed: Feb. 7, 2020

(86) PCT No.: PCT/JP2020/004957
§ 371 (c)(1),
(2) Date: Jul. 19, 2021

(87) PCT Pub. No.: WO2020/162624
PCT Pub. Date: Aug. 13, 2020

(65) Prior Publication Data

US 2022/0081809 A1 Mar. 17, 2022

(30) Foreign Application Priority Data

Feb. 8, 2019 (JP) ..... 2019-022012

(51) Int. Cl.
*D03D 15/283* (2021.01)
*D03D 13/00* (2006.01)
(Continued)

(52) U.S. Cl.
CPC ..... *D03D 15/283* (2021.01); *D03D 13/004* (2013.01); *D03D 15/00* (2013.01); *D03D 15/41* (2021.01); *D03D 15/56* (2021.01)

(58) Field of Classification Search
CPC ..... D03D 15/283; D03D 15/41; D03D 15/47; D03D 15/56; D03D 15/587; D03D 13/004; D03D 15/00; D02G 3/38
(Continued)

(56) References Cited

U.S. PATENT DOCUMENTS

2006/0053837 A1 3/2006 Oya
2012/0190260 A1 7/2012 Morishita

FOREIGN PATENT DOCUMENTS

CN 205474225 U 8/2016
CN 108265375 A 7/2018
(Continued)

OTHER PUBLICATIONS

International Search Report issued in corresponding International Patent Application No. PCT/JP2020/004957 dated Apr. 21, 2020.
(Continued)

*Primary Examiner* — Camie S Thompson
(74) *Attorney, Agent, or Firm* — Morgan, Lewis & Bockius LLP

(57) ABSTRACT

The present disclosure relates to: a woven fabric which is constituted from a bare yarn (A yarn) of an elastic polyurethane yarn, and a non-elastic yarn or a composite yarn (B yarn) of a non-elastic yarn and an elastic polyurethane yarn, and which is characterized in that at an intersecting portion of a warp and a weft, a specific region is present where the warp and the weft are both the A yarn, the warp and the weft are bonded or melt bonded to each other in this specific region, and the ratio of the number of intersections between A yarns of warp and weft in the specific region relative to the total number of intersections between warp and weft in the entire structure of the woven fabric is 0.02-50%; a method for producing same; and a fiber product containing the woven fabric.

14 Claims, 6 Drawing Sheets

(51) Int. Cl.
*D03D 15/00* (2021.01)
*D03D 15/41* (2021.01)
*D03D 15/56* (2021.01)

(58) Field of Classification Search
USPC ..... 442/184
See application file for complete search history.

(56) References Cited

FOREIGN PATENT DOCUMENTS

| | | | |
|---|---|---|---|
| JP | H08-302564 | A | 11/1996 |
| JP | H09-250040 | A | 9/1997 |
| JP | H11-157802 | A | 6/1999 |
| JP | 2003-082551 | A | 3/2003 |
| JP | 2003-138445 | A | 5/2003 |
| JP | 2005-105458 | A | 4/2005 |
| JP | 3672920 | B2 | 7/2005 |
| JP | 2006-169688 | A | 6/2006 |
| JP | 2006-225798 | A | 8/2006 |
| JP | 3983729 | B2 | 9/2007 |
| JP | 2008-075230 | A | 4/2008 |
| JP | 2012-057262 | A | 3/2012 |
| JP | 2013-147762 | A | 8/2013 |
| JP | 2015-151630 | A | 8/2015 |
| JP | 2018-080418 | A | 5/2018 |
| WO | 2011/040359 | A1 | 4/2011 |

OTHER PUBLICATIONS

International Preliminary Report on Patentability and Written Opinion issued in corresponding International Patent Application No. PCT/JP2020/004957 dated Aug. 19, 2021.

WOVEN FABRIC, METHOD FOR PRODUCING SAME, AND FIBER PRODUCT CONTAINING SAID WOVEN FABRIC

FIELD

The present invention relates to a woven fabric and a method for producing it, as well as to a fiber product containing the woven fabric.

BACKGROUND

Clothing is generally produced by cutting and sewing of fabrics. Fraying at the edges of the openings of clothing articles is commonly prevented by folding over the cut edges of the fabric and sewing them together, or enveloping them with a different sheet such as tape and sewing them. However, to prevent fraying of cut edges of fabrics or cut edges at their openings requires considerable labor for sewing and can also impair the fashion property since the cut edges of underwear may appear as level differences under the outerwear, or the seams may contact with the skin and impair the feel during wear, and therefore greater improvement is needed for underwear or sports wear which is in direct contact with the skin.

As an example for meeting this need, PTL 1 proposes clothing formed with a stretchable warp knitted fabric comprising a looping texture of elastic yarn, with at least a 1×1 tricot knit of non-elastic yarn, cut at an angle of 3° to 177° with respect to the knitting direction and where the edges of the clothing are edges that do not require processing when cut.

Also, PTL 2 proposes clothing with a freely cuttable specification, comprising a knitted fabric having heat-fused elastic yarn and another yarn knitted together in a plating knit to provide an anti-fraying function.

However, this technique is only focused on knitted fabrics and does not disclose a woven fabric having a freely cuttable specification that does not require edge processing, or clothing comprising the woven fabric.

With diversification of fashion in recent years it has become common to use woven fabrics in clothing with freely cuttable specifications, not only for underwear or sports wear that directly contact with the skin, but also for shirts, slacks, women's bottoms, jackets and coats, or in other words, its demand has increased for outer wear purposes as well. From the viewpoint of wearing comfort as well, demand has recently increased for woven fabrics with suitable stretch properties to be used for such outer wear.

In regard to preventing fraying of woven fabrics, PTL 3 discloses a woven fabric having heat-soluble weft yarn heated after weaving in order to fuse it, for the purpose of preventing fraying of unit mat-type woven fabrics such as coasters and table cloths, as well as a method for producing it. However, since heat-soluble yarn is only used for the weft yarn, the anti-fraying property in the warp direction of the woven fabric is inadequate. Furthermore, since heat-soluble yarn is used only at the cut sections of the woven fabric, the sections that can be cut are limited and fraying can potentially occur when cuts are left at various angles, and therefore this method has been unsuitable for use in clothing.

For the purpose of preventing distorting slippage of meshed woven fabrics, PTL 4 discloses a method for producing a meshed woven fabric that is resistant to distorting slippage of the woven fabric by carrying out heat treatment of a woven fabric containing heat-fused fibers and dissolving fibers that dissolve by water or a solvent, followed by dissolving removal of some of the dissolving fibers by water or a solvent. However, since the heat-fused fibers are situated only around the holes of the mesh, fraying still occurs when cuts are left at various angles, and therefore this method has not been usable for clothing. In addition, the stretch property is poor because the fibers of the meshed woven fabric consist of fibers having a higher melting point than the heat-fused fibers, and this renders it unsuitable for clothing which must have a comfortable feel when worn.

CITATION LIST

Patent Literature

[PTL 1] Japanese Patent Publication No. 3672920

[PTL 2] Japanese Patent Publication No. 3983729

[PTL 3] Japanese Unexamined Patent Publication No. 2003-82551

[PTL 4] Japanese Unexamined Patent Publication No. 2015-151630

SUMMARY

Technical Problem

In light of this situation of the prior art, it is an object of the present invention to provide a woven fabric having a suitable stretch property and a satisfactory fray-resistant function, as well as clothing using it.

Solution to Problem

As a result of much experimentation toward achieving this object, the present inventors have completed this invention upon unexpectedly finding that it can be achieved if the some of the intersections between the warp yarn and weft yarn of the woven fabric are composed entirely of polyurethane elastic yarn bare threads.

Specifically, the present invention is as follows.

[1] A woven fabric composed of polyurethane elastic yarn bare threads (A threads) and non-elastic yarn or composite yarn comprising non-elastic yarn and polyurethane elastic yarn (B threads), wherein specific regions where both the warp yarn and weft yarn are A threads are present at the intersections between the warp yarn and weft yarn, the warp yarn and weft yarn being bonded or melt bonded at the specific regions, and in a weave repeat of the woven fabric, the proportion of the number of intersections between A threads of the warp yarn and weft yarn in the specific regions with respect to the total number of intersections between warp yarn and weft yarn is 0.02% to 50%.

[2] The woven fabric according to [1] above, wherein the number of intersections between warp B threads and weft B threads in a region delineated by the four intersections between two warp A threads adjacent in the weft direction sandwiching a warp B thread, and two weft A threads adjacent in the warp direction sandwiching a weft B thread, is 10,000 or less.

[3] The woven fabric according to [1] or [2] above, wherein the warp A threads in the weft direction and/or the weft A threads in the warp direction are present with at least two or more in continuity.

[4] The woven fabric according to any one of [1] to [3] above, wherein the composite yarn comprising non-elastic yarn and polyurethane elastic yarn (warp B threads and weft B threads) is a single covering yarn with polyurethane elastic fiber as the core thread and non-elastic yarn as the sheath thread, and with a covering draft of 1.0 to 4.0 and a twist coefficient K calculated from the following formula (1):

$$K=T/\sqrt{(10,000/D)} \quad (1)$$

{where T is the number of turns of the sheath thread wrapped around 1 meter of core thread during processing (T/m) and D is the non-elastic yarn fineness (dtex)} of 18 to 85.

[5] A method for producing a woven fabric, comprising the following steps:

- a step of weaving using composite yarn comprising soluble fibers that dissolve in water and/or a solvent and polyurethane elastic fibers, and non-elastic yarn or composite yarn comprising non-elastic yarn and polyurethane elastic yarn (B threads), for some of the warp yarn and weft yarn;
- a step of dissolving removal of the soluble fibers with water and/or a solvent to form specific regions of polyurethane elastic yarn bare threads (A threads) comprising the warp yarn and weft yarn together; and
- a step of consolidating or fusing together the warp A threads and weft A threads in the specific regions.

[6] The method according to [5] above, wherein the step of consolidating or fusing together the warp A threads and weft A threads in the specific regions is consolidation or fusion by thermal processing.

[7] The method according to [5] or [6] above, wherein the composite yarn comprising non-elastic yarn and polyurethane elastic fiber (warp B threads and weft B threads) is a single covering yarn with polyurethane elastic fiber as the core thread and non-elastic yarn as the sheath thread, and with a covering draft of 1.0 to 4.0 and a twist coefficient K calculated from the following formula (2):

$$K=T/\sqrt{(10,000/D)} \quad (1)$$

{where T is the number of turns of the sheath thread wrapped around 1 meter of core thread during processing (T/m) and D is the non-elastic yarn fineness (dtex)} of 18 to 85.

[8] A fiber product that includes a woven fabric according to any one of [1] to [4] above.

[9] The fiber product according to [8] above, which has a freely cuttable specification.

[10] The fiber product according to [8] or [9] above, which is an article of clothing.

Advantageous Effects of Invention

Since the woven fabric of the invention has a suitable stretch property and excellent fraying resistance, it can be used to obtain fiber products that include clothing without fraying on the fabric edges even with repeated washing and wearing, and with a freely cuttable specification that does not require edge processing.

Figure 1:
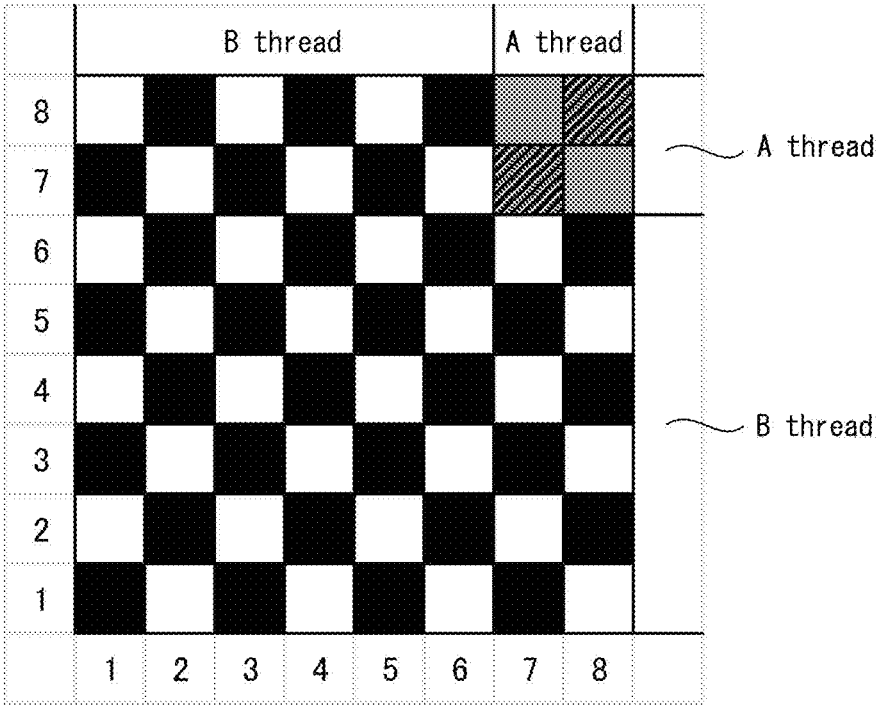
FIG. 1 shows the weave repeat of the plain weave used in Examples 1, 8, 9 and 12 to 16.

A woven fabric pattern is based on and composed of a repeated unit pattern. Such a unit pattern is referred to as a weave repeat. A weave repeat is the minimum representation of the pattern composing the woven fabric, and in FIGS. 1 to 6, sections where warp yarn is laid over weft yarn are represented by black and shaded areas.

DESCRIPTION OF EMBODIMENTS

Embodiments of the invention will now be described in detail.

The woven fabric of this embodiment is composed of polyurethane elastic yarn bare threads (A threads) and non-elastic yarn or composite yarn comprising non-elastic yarn and polyurethane elastic yarn (B threads), wherein specific regions where both the warp yarn and weft yarn are A threads are present at the intersections between the warp yarn and weft yarn, the warp yarn and weft yarn being bonded or melt bonded at the specific regions, and in a weave repeat of the woven fabric, the proportion of the number of intersections between A threads of the warp yarn and weft yarn in the specific regions with respect to the total number of intersections between warp yarn and weft yarn is 0.02% to 50%.

Throughout the present specification, the term "consolidation" refers to elastic yarns that have been deformed together by processing to become intertwined at the intersections between the polyurethane elastic yarns, but in a state where the intersections can be cleanly disassembled without breaking them up, while the term "fusion" refers to a state where the elastic yarns at the intersections fuse and become partially integrated, such that the intersections cannot be disassembled without breaking them up.

Polyurethane elastic yarn (fibers) may be polymerized from a polyol, diisocyanate compound, diamine compound or diol compound, with no particular limitation to these. The method of synthesis is also not particularly restricted. Polyurethane-based fibers may be polyurethane fibers polymerized from a polymer diol, diisocyanate and low molecular weight diamine (polyurethane-urea fibers), or polyurethane fibers polymerized from a polymer diol, diisocyanate and low molecular weight diol (polyurethane-urethane fibers), for example. They may also be polyurethane-urea fibers using a compound having a hydroxyl group and an amino group in the molecule, as a chain extender. A trifunctional or greater polyfunctional glycol or isocyanate may also be used, so long as the desired effect is exhibited. A polymer diol may be a polyether-based diol, polyester-based diol or polycarbonate diol, with no limitation to these.

The polyurethane elastic yarn bare threads (A threads) composing the woven fabric of this embodiment are preferably thermal-bonding elastic fibers and/or thermal-consolidating elastic fibers, from the viewpoint of fraying resistance.

When composite yarn comprising soluble fibers that dissolve with water and/or a solvent and polyurethane elastic fibers are laid and woven for at least some of the warp yarns and at least some of the weft yarns, with removal of the soluble fibers by dissolution with the water and/or a solvent, if the soluble fibers are alkali-soluble fibers, then the polyurethane elastic yarn bare threads (A threads) are most preferably polyether-based polyurethane elastic fibers which have excellent alkali resistance. The polyurethane elastic yarn bare threads (A threads) may include components other than polyurethane so long as the desired effect is not impaired, and when the soluble fibers are to be removed by dissolution with water and/or a solvent, they may include undissolved or dissolved remains of the soluble fibers.

Examples for the thermal-bonding elastic fibers or thermal-consolidating elastic fibers include MOBILON (trade name of Nisshinbo Industries, Inc.) and ROICA SF (trade name of Asahi Kasei Corp.), but there is no limitation to these so long as they are elastic fibers that fuse together by heat, or are elastic fibers that deform to become consolidated by heat.

The fineness, filament numbers and cross-sectional shapes of the polyurethane elastic fibers are not particularly restricted. For example, the yarn may be a monofilament consisting of a single thread, or a multifilament composed of multiple single threads. The cross-sectional shapes of the yarns may be circular, but they may also be flat or cocoon-shaped.

The bare threads of the polyurethane elastic fibers (A threads) are preferably threads with a total denier of 5 to 2500 dtex. A value of 5 dtex or greater will provide sufficiently high elongation and practical strength for fabrics. A value of 2500 dtex or lower, on the other hand, will allow normal dyeing equipment to be used for processing without resulting in excessively high stretching force of the fabric. When polyurethane elastic yarn bare threads are to be laid for at least some of the warp yarn and at least some of the weft yarn forming the woven fabric, and the bare threads are to be directly woven, the value is preferably 22 dtex or greater.

The non-elastic yarn or composite yarn of non-elastic yarn and polyurethane elastic yarn (B threads) is not particularly restricted, but it is preferably composite yarn of non-elastic yarn and polyurethane elastic yarn from the viewpoint of obtaining a suitable stretch property and from the viewpoint of dimensional stability of the woven fabric.

The non-elastic yarn composing the B threads is not particularly restricted, and examples of filament yarns include chemical synthetic fibers such as polyamide-based fibers, polyester-based fibers, acrylic fibers, polypropylene-based fibers, vinyl chloride-based fibers and cellulose-based fibers. The form of the filament yarn may be starting filaments (unprocessed yarn), false twisted yarn, colored yarn or the like, or it may be a composite of these. The cross-sectional shape of the filament yarn is not particularly restricted and may be round, triangular, cross-shaped, W-shaped, M-shaped, C-shaped, I-shaped, dogbone-shaped, hollow fiber-shaped or the like. As spun yarn, there are preferred natural fibers such as (tree) cotton, wool or hemp, or combined fibers with chemical synthetic fibers such as polyamide-based fibers, polyester-based fibers, acrylic fiber fibers, polypropylene-based fibers, vinyl chloride-based fibers, cellulosic fibers or the like, any of which may be used alone or as mixed spun fibers. The non-elastic yarns composing the B threads may also include additives such as delustering agents, stabilizers or antistatic agents. In other words, appropriate materials may be selected for use depending on the purpose.

Polyurethane elastic yarn to be combined with the non-elastic yarn for the B threads is not particularly restricted, but from the viewpoint of fraying resistance it is preferably composed of thermal-bonding elastic fibers and/or thermal-consolidating elastic fibers.

When composite yarn comprising soluble fibers that dissolve with water and/or a solvent and polyurethane elastic fibers are laid and woven for at least some of the warp yarns and at least some of the weft yarns, with removal of the soluble fibers by dissolution with water and/or a solvent, if the soluble fibers are alkali-soluble fibers, then the polyurethane elastic fibers composing the B threads are most preferably polyether-based polyurethane elastic fibers which have excellent alkali resistance.

The fineness, filament numbers and cross-sectional shapes of the polyurethane elastic fibers composing the B threads are not particularly restricted. For example, the yarn may be a monofilament consisting of a single thread, or a multifilament composed of multiple single threads. The cross-sectional shapes of the yarns may be circular, but they may also be flat or cocoon-shaped.

The polyurethane elastic fibers composing the B threads are preferably yarn with a total fineness of 5 to 2500 dtex. A value of 5 dtex or greater will provide sufficiently high elongation and practical strength for fabrics. A value of 2500 dtex or lower, on the other hand, will allow normal dyeing equipment to be used for processing without resulting in excessively high stretching force of the fabric.

When at least some of the warp yarn and at least some of the weft yarn are to be woven by composite yarn comprising soluble fibers that dissolve in water and/or a solvent and polyurethane elastic fibers, and water-soluble fibers are used for the soluble fibers, then the non-elastic fibers composing the B threads may be fibers other than water-soluble fibers. When alkali-soluble fibers are used for the soluble fibers, the non-elastic fibers used to compose the B threads are preferably polyester fibers, nylon fibers, or cellulose-based fibers such as cotton or rayon, which have excellent alkali resistance, or combinations of these fibers.

When composite yarn of non-elastic yarn and polyurethane elastic yarn is used for the B threads, the method of mixing (combining) the non-elastic fibers and polyurethane elastic fibers is not particularly restricted. For example, it may be composite yarn such as single covering yarn, double covering yarn, air covering yarn or doubled twisted yarn, having polyurethane elastic fibers for the core thread covered by non-elastic yarn for the winding thread, while from the viewpoint of productivity and cost, it is preferably single covering yarn or air covering yarn and more preferably single covering yarn. When single covering yarn is used, the covering draft is preferably 1.0 to 4.0 and more preferably 1.8 to 2.8. The covering draft is preferably 1.0 or greater because the woven fabric will have an adequate stretch property, and it is preferably 4.0 or lower because the woven fabric will not exhibit graininess or impaired aesthetic quality or feel, and will have a high weaving property. For single covering yarn, the twist coefficient K calculated from the following formula (1):

$$K=T/\sqrt{(10{,}000/D)} \quad (1)$$

{where T is the number of turns of the sheath thread wrapped around 1 meter of core thread during processing (T/m) and D is the non-elastic yarn fineness (dtex)} is preferably 18 to 85, more preferably 28 to 66 and even more preferably 37 to 47. The twist coefficient K is preferably 18 or greater because the woven fabric will be less likely to have defects, with the polyurethane being resistant to breakage during weaving, for example, while it is also preferably 85 or lower because the cost of the covered thread will be lower, the woven fabric will be less likely to be grainy or have impaired aesthetic quality of the fabric surface, and the free cut performance include fraying resistance will be higher.

The method of compositing the non-elastic fibers and polyurethane elastic fibers may be one or a combination of different methods. The compositing conditions may be in the range of commonly employed conditions. The obtained yarn may also be post-treated by a commonly known method. Preparation steps for the obtained composite yarn may include any steps known in the prior art, including sizing or wax treatment.

For the woven fabric of this embodiment, a specific region exists at the intersections between the warp yarn and weft yarn where the warp yarn and weft yarn are both A threads, with the warp yarn and weft yarn being bonded or melt bonded in the specific regions, and in one weave repeat of the woven fabric, the proportion of the number of intersections between A threads of the warp yarn and weft yarn in the specific region with respect to the total number of warp yarn-weft yarn intersections is 0.02% to 50%, preferably 0.1% to 40% and more preferably 1.0% to 25%. If the proportion is lower than 0.02% it will not be possible to obtain sufficient fraying resistance with washing, while if it is higher than 50% the feel of the woven fabric will become rubber-like, thus impairing the feel on the skin when used in clothing, and lowering the strength of the woven fabric as well. The proportion of intersections between A threads of warp yarn and weft yarn in the specific region with respect to the total number of warp yarn-weft yarn intersections is calculated by visually identifying a weave repeat of the woven fabric using a magnifying lens and measuring for any one weave repeat.

For the woven fabric of the embodiment, the number of warp B thread-weft B thread intersections in a region delineated by four intersections between two warp A threads adjacent in the weft direction sandwiching a warp B thread and two weft A threads adjacent in the warp direction sandwiching a weft B thread, is preferably from 1 to 10,000, more preferably from 1 to 2500 and even more preferably from 1 to 500. If the number of warp B thread-weft B thread intersections is 10,000 or less it will be possible to obtain adequate fraying resistance.

The pattern of the woven fabric of the embodiment is not particularly restricted, and examples include three foundational types of weaves such as a plain weave, twill weave or satin weave, derivative weaves such as a derivative plain weave, derivative twill weave or derivative satin weave, special weaves such as a honeycomb weave, mock leno weave or crepe weave, half-double weaves such as a warp backed weave or weft backed weave, double woven textures such as a reversible figured double weave, hollow weave or double velvet weave, multilayer textures such as a belt weave, vertical pile weaves such as a warp velvet, towel, seal or velour weave, horizontal pile weaves such as velveteen, weft velvet, velvet or corduroy, and entangled textures such as leno, gauze or monsha weave, or mixed weaves comprising any two or more of these, with a plain weave being preferred to obtain satisfactory fraying resistance for washing.

The weft stretch factor in the woven fabric of the embodiment is preferably 10% or greater, more preferably 15% or greater and even more preferably 20% or greater. If the stretch factor is 10% or greater the elongation of the fabric during wear will be high when the woven fabric is used for clothing, so that sufficient wearable comfort can be obtained without a compressed feeling. The stretch recovery rate for warp and weft in the woven fabric is preferably 50% or greater, more preferably 60% or greater and even more preferably 65% or greater. The stretch recovery rate of the woven fabric is preferably 50% or greater for an excellent fitting feel when the woven fabric is used for clothing.

The fraying resistance in a wash fraying test for the woven fabric of the embodiment is preferably grade 3 or higher. If the fraying resistance is below grade 3 then fraying will occur at the fabric edges resulting in poor quality, when it is worn as cut-off clothing or subjected to repeated washing.

In the woven fabric of the embodiment, preferably the warp A threads in the weft direction and/or weft A threads in the warp direction are present with at least two or more in continuity. This will help ensure the desired fraying resistance.

A method for producing a woven fabric of this embodiment will now be described.

The woven fabric of this embodiment may be woven using polyurethane elastic yarn bare threads or composite yarn comprising polyurethane elastic yarn and soluble fibers (A threads) and non-elastic yarn or composite yarn comprising non-elastic yarn and polyurethane elastic yarn (B threads). The weaving method is not particularly restricted, but is preferably carried out with a shuttle loom (fly shuttle loom or the like) or a shuttleless loom (rapier loom, gripper loom, water jet loom, air jet loom or the like). When a water jet loom is used, the soluble fibers used are preferably fibers other than water-soluble fibers.

Polyurethane elastic yarn bare threads used as the A threads may also be directly woven as the weft yarn, in which case it is preferred to use a rapier loom.

A woven fabric of this embodiment may be produced by a method comprising the following steps:

- a step of weaving using composite yarn comprising soluble fibers that dissolve in water and/or a solvent and polyurethane elastic fibers, and non-elastic yarn or composite yarn comprising non-elastic yarn and polyurethane elastic yarn (B threads), for some of the warp yarn and weft yarn;
- a step of dissolving removal of the soluble fibers with water and/or a solvent to form specific regions of polyurethane elastic yarn bare threads (A threads) comprising the warp yarn and weft yarn together; and
- a step of consolidating or fusing together the warp A threads and weft A threads in the specific regions.

For production of a woven fabric according to this embodiment, when at least some of the warp yarn and at least some of the weft yarn is composite yarn comprising soluble fibers that dissolve in water and/or a solvent, and polyurethane elastic fibers, then there are no particular restrictions on the method of compositing the soluble fibers and polyurethane elastic fibers. For example, it may be composite yarn such as single covering yarn, double covering yarn, air covering yarn or doubled twisted yarn, having polyurethane elastic fibers for the core thread covered by soluble fibers that dissolve in water and/or a solvent, for the winding thread, while from the viewpoint of productivity and cost, it is preferably single covering yarn or air covering yarn and more preferably single covering yarn.

When single covering yarn is used, the covering draft is preferably 1.0 to 4.0, more preferably 1.5 to 3.5 and even more preferably 2.0 to 3.0. The covering draft is preferably 1.0 or greater because the woven fabric will have an adequate stretch property, while it is preferably 4.0 or lower because the woven fabric will not exhibit graininess or impaired aesthetic quality or feel, and will have a high weaving property.

For composite yarn comprising soluble fibers that dissolve in water and/or a solvent and polyurethane elastic fibers, the twist coefficient K of the covered thread having polyurethane elastic fibers as the core thread and soluble fibers that dissolve in water and/or a solvent as the sheath thread, as calculated by the following formula (2):

$$K=T/\sqrt{(10{,}000/D)} \quad (2)$$

{where T is the number of turns of the sheath thread wrapped around 1 meter of core thread during processing (T/m) and D is the fineness (dtex) of the soluble fibers that dissolve in water and/or a solvent}, is preferably 18 to 85, more preferably 28 to 66 and even more preferably 37 to 47, from the viewpoint of weavability and cost. The twist coefficient K is preferably 18 or greater for resistance to breakage of the polyurethane during weaving and other woven fabric defects, while it is also 85 or smaller in order to reduce the cost of the covered thread.

The method of compositing the soluble fibers and polyurethane elastic fibers may be one or a combination of different methods. The compositing conditions may be commonly employed conditions. The obtained yarn may also be post-treated by a commonly known method. Preparation steps for the obtained composite yarn may include any steps known in the prior art, including sizing or wax treatment.

Examples of soluble fibers that dissolve in water and/or solvents include water-soluble fibers such as polyvinyl alcohol-based fibers, polyester-based fibers copolymerized with a third component such as isophthalic acid, 5-sodium-sulfoisophthalic acid or methoxypolyoxyethylene glycol, alkali-soluble fibers such as polylactic acid-based fibers, and alkali-soluble acrylic fibers, with no particular limitation to these. These may be used alone or in combinations of two or more, or with two or more fibers composited in a single yarn. When used in composited form, alignment, doubling or combined twisting may also be used.

For the woven fabric of the embodiment, when weaving is with composite yarn comprising soluble fibers that dissolve in water and/or a specific solvent and polyurethane elastic fibers, and non-elastic yarn or composite yarn comprising non-elastic yarn and polyurethane elastic yarn, at least some of the soluble fibers are removed by dissolution with water and/or a solvent to expose the polyurethane elastic fibers, and then the woven fabric is processed for fusion or consolidation of the polyurethane elastic fibers laid as the warp threads and weft threads. The method for removing the soluble fibers by dissolution may be immersion of the woven fabric in water when the soluble fibers are water-soluble fibers such as polyvinyl alcohol-based fibers. The water temperature is preferably 20° C. or higher, and the dissolving removal is more preferably in a bath at 50° C. to 100° C., but this is not limitative so long as they are conditions in which the water-soluble fibers can be removed by dissolution. When the soluble fibers are alkali-soluble fibers, the woven fabric may be immersed in an aqueous alkali solution containing sodium hydroxide. The temperature of the solution is preferably 80 to 100° C., the time is preferably 10 to 30 minutes, the sodium hydroxide concentration is preferably 0.5 to 3% ows and the liquor to goods ratio is preferably 1:30 to 1:50, but these conditions are not limitative so long as they are conditions in which the alkali-soluble fibers can be removed by dissolution.

There is no particular restriction on the method of consolidating or fusing together the warp A threads and weft A threads in the specific regions where both the warp yarn and weft yarn are polyurethane elastic yarn bare threads (A threads), and heat treatment (dry heat treatment or moist heat treatment) or ultrasonic treatment, contact bonding or the like may be used, although heat treatment is more preferred from the viewpoint of ease of treatment.

When the woven fabric is to be subjected to dry heat treatment, the treatment temperature is preferably 140 to 210° C. and the processing time is preferably 30 seconds to 90 seconds. When the woven fabric is to be subjected to moist heat treatment, the treatment temperature is preferably 80 to 140° C. and the processing time is preferably 15 seconds to 30 minutes. For moist heat treatment it is preferred to use an apparatus that allows uniform heating of the fiber structure, such as an ordinary pressure steamer or high pressure steamer, with no limitation to these. Such heat treatment allows consolidation or fusion by thermal processing during the step of consolidation or fusion between the warp A threads and weft A threads.

So long as the desired effect is not impaired, the woven fabric of the embodiment may be treated in various manners in addition to common dye finish treatment, such as alkali reduction treatment, piling treatment, water absorption treatment, water repellency treatment, ultraviolet shielding treatment, thermal storage treatment, antimicrobial treatment, print treatment, opal finishing, heat embossing, punching or calendering. In addition, other forms of treatment may also be applied, such as treatment using antistatic agents, antimicrobial agents, deodorants, insecticides, luminous agents, retroreflective agents, minus ion generators and the like.

The woven fabric of the embodiment is preferably used as a fiber product, examples of which include clothing products such as sports wear, swimwear, homewear, coats, suits, blousons, blouses, shirts, skirts, slacks, kimonos, clothing back fabrics, indoor exercise wear, pajamas, nightwear, underwear, brassieres, shorts, lingerie, foundations, camisoles, under dresses, petticoats, sock opening rubber, waistbands, office wear, work clothes, food lab coats, nursing white coats, patient gowns, caregiving clothing, medical wear, school uniforms and kitchen wear. Other preferred fiber products include miscellaneous goods such as gloves, neckties, scarfs, shawls, aprons, towels, mufflers, socks, caps, shoes, sandals, bandages, supporters and bags, interior goods such as curtains, kotatsu covers, sofa covers, cushion covers, sofa side cover fabrics and table cloths, and bedding goods such as futon cover fabrics, sheets, futon covers, blankets and pillowcases.

EXAMPLES

The present invention will now be described in greater detail by Examples and Comparative Examples, with the understanding that the invention is not limited to the Examples. The evaluation methods used in the Examples were the following.

(1) Stretch Factor and Stretch Recovery Rate

The stretch factor (%) of the woven fabric was measured by method JIS L 1096 B (constant load method), and the stretch recovery rate (%) was measured by method JIS L 1096 B-1 (constant load method).

<Stretch Factor>

Three woven fabric test strips of 50 mm (warp direction)× 300 mm (weft direction) are prepared, and using a tensile tester, one edge of the test strip is anchored to the top clamp, while an initial load (N) corresponding to gravity acting on 1 m length at the width of the test strip is applied to the other edge. Marks are then formed at a 200 mm spacing and the initial load is removed, after which a load of 14.7 N is gently applied and the length (mm) between the marks after standing for 1 minute is measured.

The stretch factor (%) is determined by the following formula:

$$\text{Stretch factor (\%)}=(L1-L0)\times 100/L0$$

{where L0 is the original length between the marks (200 mm) and L1 is the length (mm) between the marks after standing for 1 minute with the load of 14.7 N applied}, and the average of 3 measurements is calculated and rounded to one decimal place.

A stretch factor of 10% or greater may be considered a suitable stretch property.

<Stretch Recovery Rate>

Woven fabric test strips of 50 mm width×300 mm length are prepared, three each in the warp direction and weft direction, and using a tensile tester, one edge of the test strip is anchored to the top clamp, while an initial load (N) corresponding to gravity acting on 1 m length at the width of the test strip is applied to the other edge. Marks are then formed at a 20 cm spacing and the initial load is removed, after which a load of 14.7 N is gently applied and the length (mm) between the marks after standing for 1 hour is measured. The load is then removed, the initial load is applied after 30 seconds, and the length between the marks is again measured.

The stretch recovery rate (%) is determined by the following formula:

$$\text{Stretch recovery rate (\%)}=(L1-L2)\times 100/(L1-L0)$$

{where L0 is the original length between the marks (200 mm) upon application of the initial load, L1 is the length (mm) between the marks after standing for 1 hour with the load of 14.7 N applied, and L2 is the length (mm) between the marks upon application of the initial load 30 seconds after removing the load}, and the average of 3 measurements is calculated and rounded to one decimal place.

(2) Wash Fraying Resistance

<Sample Preparation>

Three samples of the woven fabric were prepared, each cut to a square of 15 cm (warp direction)×15 cm (weft direction), and having 5 cm notches formed at angles of 45° toward the center of the woven fabric from each of the 4 corners.

<Washing Method>

Following Washing Method #103 of JISL-0217:1995 (Revised), employing the pulsator household electric washing machine method specified in Method G of JIS L1096-2010 (Revised), the sample was loaded with a liquid temperature of 40° C. and a liquor to goods ratio of 1:30, and washing was carried out 150 times using "Attack™" (Kao Corp.) as detergent at the manufacturer's standard concentration. When a liquor to goods ratio of 1:30 is not obtainable for the weight of the sample with respect to the liquid volume of the washing tub, an additional dummy cloth may also be included. With one washing consisting of (5 min wash—spin—2 min rinse—spin—2 min rinsing—spin), 50 washings were carried out for a total of (250 min wash—spin—2 min rinse—spin—2 min rinse), and this was repeated 3 times. The sample was then allowed to dry by natural drying on a flat table.

<Evaluation of Fraying Resistance>

Grade assessment on the following scale was made for the average maximum for fraying of the yarn at the four sides and the four notched sections of each of the 3 dried samples.

Grade 5: Average maximum of fraying <2 mm
Grade 4-5: Average maximum of fraying ≥2 mm, <3 mm
Grade 4: Average maximum of fraying ≥3 mm, <4 mm
Grade 3-4: Average maximum of fraying ≥4 mm, <5 mm
Grade 3: Average maximum of fraying ≥5 mm, <6 mm
Grade 2-3: Average maximum of fraying ≥6 mm, <7 mm
Grade 2: Average maximum of fraying ≥7 mm, <8 mm
Grade 1-2: Average maximum of fraying ≥8 mm, <9 mm
Grade 1: Average maximum of fraying ≥9 mm (3) Weavability The weavability was assessed on the following evaluation scale:

VG: No more than 3 loom stops required for each greige length, and no visibly apparent greige defects,
G: No more than 6 loom stops required for each greige length, and no readily visibly apparent greige defects,
F: No more than 10 loom stops required for each greige length, and greige defects visibly confirmed but not readily apparent,
P: 11 or more loom stops required for each greige length, or greige defects visibly apparent throughout.

(4) Evaluation of Feel

The feel of the woven fabric was organoleptically evaluated on the following 3-level scale:

G: Satisfactory feel on the skin,
F: Somewhat rubber-like,
P: Very rubber-like and poor feel on the skin

Example 1

Weaving was carried out using a double-color nozzle water jet loom by laying, for both the warp yarn and weft yarn, 6 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting, to obtain a plain weave fabric having the weave repeat shown in FIG. 1. It was then scoured (temperature: 90° C., time 10 min) and dried (air-drying) by common methods, and subjected to in-bath treatment at 95° C. for 20 minutes in a 2% sodium hydroxide solution with a liquor to goods ratio of 1:30, completely dissolving the soluble fibers, and then subjected to presetting and dyeing by acid dyeing, drying (air-drying) and finishing setting (dry heating, temperature: 180° C., time: 60 sec), by common methods, to obtain a plain weave fabric with a warp density of 275/2.54 cm and a weft density of 201/2.54 cm. The results of performance evaluation for the obtained woven fabric are shown in Table 1.

Example 2

Figure 2:
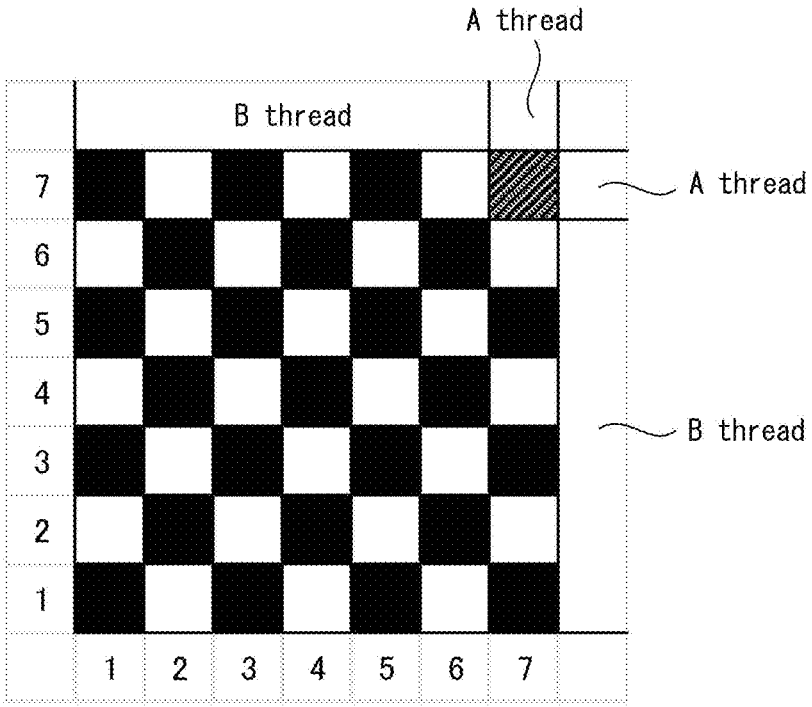
FIG. 2 shows the weave repeat of the plain weave fabric used in Example 2.

A plain weave fabric with the weave repeat shown in FIG. 2, having a warp density of 275/2.54 cm and a weft density of 201/2.54 cm, was obtained in the same manner as Example 1 except for laying, for both the warp yarn and weft yarn, 6 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying one single covering yarn having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 1.

Example 3

A plain weave fabric with a warp density of 275/2.54 cm and a weft density of 201/2.54 cm was obtained in the same manner as Example 1 except for laying, for both the warp yarn and weft yarn, 40 single covering yarns having 22 dtex polyurethane elastic fiber as the core thread and 22 dtex/20 filament nylon 66 false twisted crimp finished yarn as the sheath thread, with a polyurethane elastic fiber draft of 2.3 and 800 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.3 and 800 T/m twisting. The results of performance evaluation for the obtained woven fabric are shown in Table 1.

Example 4

A plain weave fabric with a warp density of 202/2.54 cm and a weft density of 146/2.54 cm was obtained in the same manner as Example 1 except for laying, for both the warp yarn and weft yarn, 50 single covering yarns having 22 dtex polyurethane elastic fiber as the core thread and 44 dtex/34 filament nylon 66 false twisted crimp finished yarn as the sheath thread, with a polyurethane elastic fiber draft of 2.5 and 700 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.3 and 800 T/m twisting. The results of performance evaluation for the obtained woven fabric are shown in Table 1.

Example 5

A plain weave fabric with a warp density of 275/2.54 cm and a weft density of 201/2.54 cm was obtained in the same manner as Example 1 except for laying, for both the warp yarn and weft yarn, 88 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.3 and 800 T/m twisting. The results of performance evaluation for the obtained woven fabric are shown in Table 1.

Example 6

Figure 3:
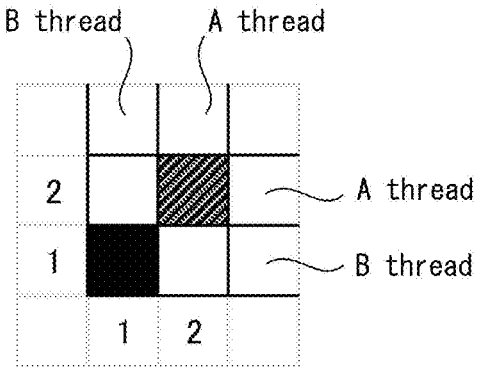
FIG. 3 shows the weave repeat of the plain weave fabric used in Example 6.

A plain weave fabric with the weave repeat shown in FIG. 3, having a warp density of 229/2.54 cm and a weft density of 169/2.54 cm, was obtained in the same manner as Example 1 except for laying, for both the warp yarn and weft yarn, 1 single covering yarn having 22 dtex polyurethane elastic fiber as the core thread and 33 dtex/26 filament nylon 66 false twisted crimp finished yarn as the sheath thread, with a polyurethane elastic fiber draft of 2.5 and 800 T/m twisting, and then laying one single covering yarn having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 1.

Example 7

Figure 4:
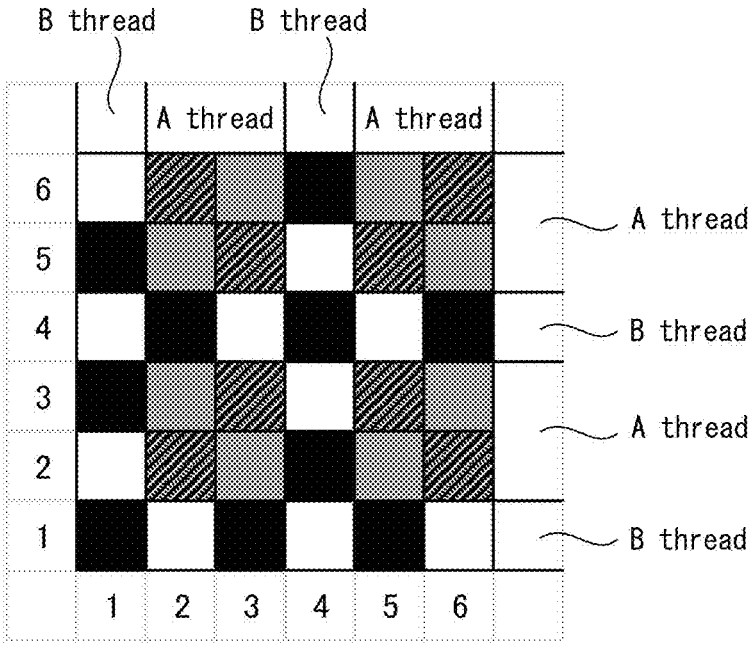
FIG. 4 shows the weave repeat of the plain weave fabric used in Example 7.

A plain weave fabric with the weave repeat shown in FIG. 4, having a warp density of 229/2.54 cm and a weft density of 169/2.54 cm, was obtained in the same manner as Example 1 except for laying, for both the warp yarn and weft yarn, 2 single covering yarns having 22 dtex polyurethane elastic fiber as the core thread and 33 dtex/26 filament nylon 66 false twisted crimp finished yarn as the sheath thread, with a polyurethane elastic fiber draft of 2.5 and 800 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 1.

Example 8

A plain weave fabric with the weave repeat shown in FIG. 1, having a warp density of 275/2.54 cm and a weft density of 201/2.54 cm, was obtained in the same manner as Example 1 except for laying, for both the warp yarn and weft yarn, 6 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 500 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 1.

Example 9

A plain weave fabric with the weave repeat shown in FIG. 1, having a warp density of 275/2.54 cm and a weft density of 201/2.54 cm, was obtained in the same manner as Example 1 except for laying, for both the warp yarn and weft yarn, 6 single covering yarn having 22 dtex polyurethane elastic fiber as the core thread and 22 dtex/20 filament nylon 66 false twisted crimp finished yarn as the sheath thread, with a polyurethane elastic fiber draft of 2.5 and 1200 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 1.

Example 10

Figure 5:
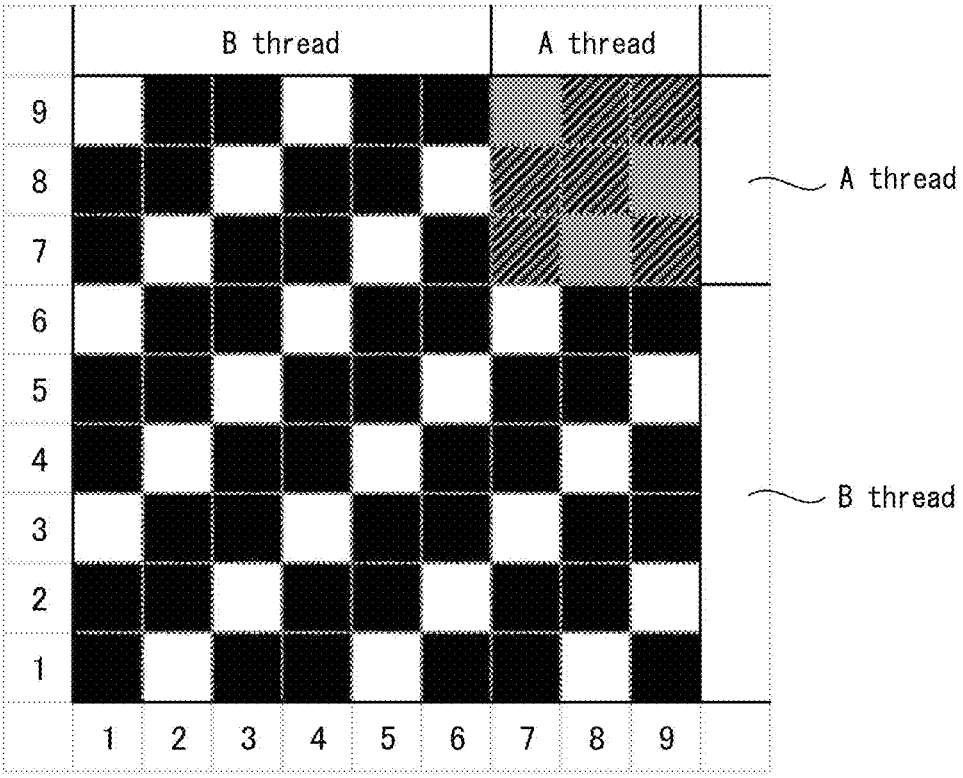
FIG. 5 shows the weave repeat of the twill weave fabric used in Example 10.

Weaving was carried out using a double-color nozzle water jet loom by laying, for both the warp yarn and weft yarn, 6 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying three single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.2 and 800 T/m twisting, to obtain a twill weave fabric having the weave repeat shown in FIG. 5. It was then scoured (temperature: 90° C., time 10 min) and dried (air-drying) by common methods, and subjected to in-bath treatment at 95° C. for 20 minutes in a 2% sodium hydroxide solution, completely dissolving the soluble fibers, and then subjected to presetting, dyeing, drying (air-drying) and finishing setting (dry heating, temperature: 180° C., time: 60 sec), to obtain a twill weave fabric with a warp density of 330/2.54 cm and a weft density of 240/2.54 cm. The results of performance evaluation for the obtained woven fabric are shown in Table 1.

Example 11

Figure 6:
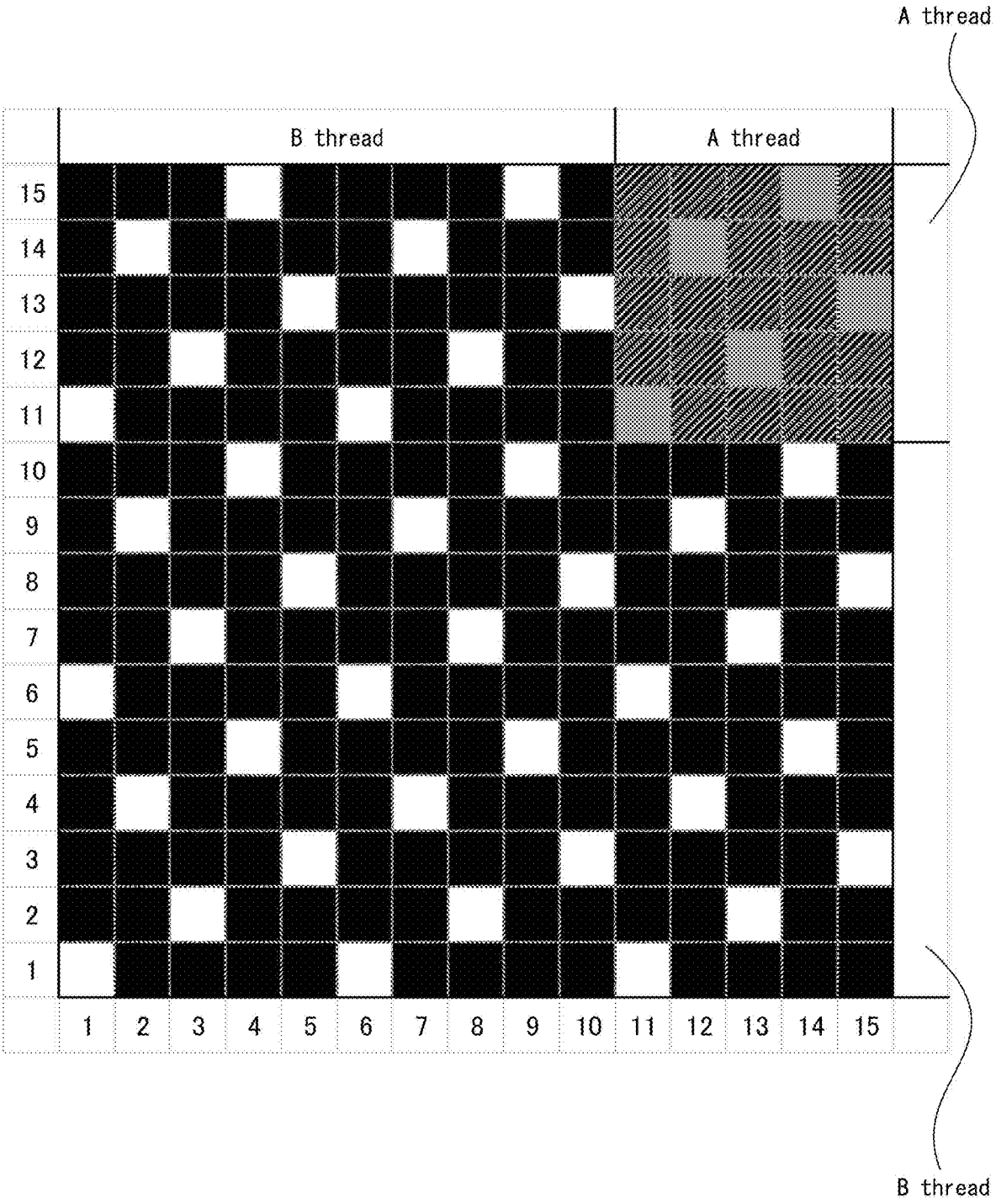
FIG. 6 shows the weave repeat of the satin weave fabric used in Example 11.

Weaving was carried out using a double-color nozzle water jet loom by laying, for both the warp yarn and weft yarn, 10 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying 5 single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.2 and 800 T/m twisting, to obtain a satin weave fabric having the weave repeat shown in FIG. 6. It was then scoured (temperature: 90° C., time 10 min) and dried (air-drying) by common methods, and subjected to in-bath treatment at 95° C. for 20 minutes in a 2% sodium hydroxide solution, completely dissolving the soluble fibers, and then subjected to presetting, dyeing, drying (air-drying) and finishing setting (dry heating, temperature: 180° C., time: 60 sec), to obtain a satin weave fabric with a warp density of 373/2.54 cm and a weft density of 280/2.54 cm. The results of performance evaluation for the obtained woven fabric are shown in Table 2.

Example 12

A plain weave fabric with the weave repeat shown in FIG. 1, having a warp density of 275/2.54 cm and a weft density of 201/2.54 cm, was obtained in the same manner as Example 1 except for laying, for both the warp yarn and weft yarn, 6 air covering yarns obtained by air interlacing 22 dtex polyurethane elastic fiber at a draft of 2.8 and 22 dtex/20 filament nylon 66 false twisted crimp finished yarn, and then laying two air covering yarns obtained by air interlacing 22 dtex thermal-consolidating elastic fibers ("ROICA SF", trade name of Asahi Kasei Corp.) at a draft of 2.8 and 33 dtex/12 filament soluble fibers ("BELPURE", trade name of KB Seiren, Ltd.). The results of performance evaluation for the obtained woven fabric are shown in Table 2.

Example 13

A plain weave fabric with the weave repeat shown in FIG. 1, having a warp density of 275/2.54 cm and a weft density of 201/2.54 cm, was obtained in the same manner as Example 1 except for laying, for both the warp yarn and weft yarn, 6 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying two air covering yarns obtained by air interlacing 22 dtex thermal-consolidating elastic fibers ("ROICA SF", trade name of Asahi Kasei Corp.) at a draft of 2.8 and 33 dtex/12 filament soluble fibers ("BELPURE", trade name of KB Seiren, Ltd.). The results of performance evaluation for the obtained woven fabric are shown in Table 2.

Example 14

Weaving was carried out using a rapier loom by laying, for the warp yarn, 6 single covering yarns having 22 dtex polyurethane elastic fiber as the core thread and 22 dtex/20 filament nylon 66 false twisted crimp finished yarn as the sheath thread with a polyurethane elastic fiber draft of 2.5 and 1000 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 1000 T/m twisting, and for the weft yarn, 6 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 1000 T/m twisting, and then laying two 22 dtex thermal-consolidating elastic fibers ("ROICA SF", trade name of Asahi Kasei Corp.) as bare threads (polyurethane elastic fiber alone), to obtain a plain weave fabric having the weave repeat shown in FIG. 1. It was then scoured (temperature: 90° C., time 10 min) and dried (air-drying) by common methods, and subjected to in-bath treatment at 95° C. for 20 minutes in a 2% sodium hydroxide solution, completely dissolving the soluble fibers, and then subjected to presetting, dyeing, drying (air-drying) and finishing setting (dry heating, temperature: 180° C., time: 60 sec), to obtain a plain weave fabric with a warp density of 261/2.54 cm and a weft density of 201/2.54 cm. The results of performance evaluation for the obtained woven fabric are shown in Table 2.

Example 15

A plain weave fabric with the weave repeat shown in FIG. 1, having a warp density of 275/2.54 cm and a weft density of 201/2.54 cm, was obtained in the same manner as Example 1 except for laying, for both the warp yarn and weft yarn, 6 single covering yarns having 22 dtex thermal-consolidating elastic fibers ("ROICA SF", trade name of Asahi Kasei Corp.) as the core thread and 22 dtex/20 filament nylon 66 false twisted crimp finished yarn as the sheath thread, with a polyurethane elastic fiber draft of 2.5 and 900 T/m twisting, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.4 and 800 T/m twisting. The results of performance evaluation for the obtained woven fabric are shown in Table 2.

Example 16

A plain weave fabric with the weave repeat shown in FIG. 1, having a warp density of 229/2.54 cm and a weft density of 169/2.54 cm, was obtained in the same manner as Example 1 except for laying, for both the warp yarn and weft yarn, 6 33 dtex/26 filament nylon 66 false twisted crimp finished yarns, and then laying two single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 1000 T/m twisting. The results of performance evaluation for the obtained woven fabric are shown in Table 2.

Comparative Example 1

A plain weave fabric with a warp density of 275/2.54 cm and a weft density of 201/2.54 cm was obtained in the same manner as Example 1 except for laying, for both the warp yarn and weft yarn, 101 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying one single covering yarn having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 2.

Comparative Example 2

A plain weave fabric with a warp density of 275/2.54 cm and a weft density of 201/2.54 cm was obtained in the same manner as Example 1 except for laying, for both the warp yarn and weft yarn, 75 single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 1000 T/m twisting, and then laying one single covering yarn having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 1000 T/m twisting. The results of performance evaluation for the obtained woven fabric are shown in Table 2.

Comparative Example 3

Figure 7:
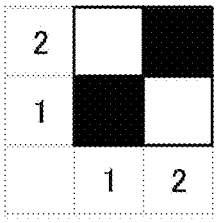
FIG. 7 shows the weave repeat of the plain weave fabric used in Comparative Example 3.

A plain weave fabric having the weave repeat shown in FIG. 7 was woven with a water jet loom, using 22 dtex/20 filament nylon 66 gray yarn for both the warp yarn and weft yarn. It was then scoured (temperature: 90° C., time 10 min) and dried (air-drying) by common methods, and subjected to presetting, dyeing by acid dyeing, drying (air-drying) and finishing setting (dry heating, temperature: 180° C., time: 60 sec), by common methods, to obtain a plain weave fabric with a warp density of 210/2.54 cm and a weft density of 168/2.54 cm. The results of performance evaluation for the obtained woven fabric are shown in Table 2.

Comparative Example 4

A plain weave fabric with a warp density of 275/2.54 cm and a weft density of 201/2.54 cm was obtained in the same manner as Example 1 except for laying, for both the warp yarn and weft yarn, two single covering yarns having 22 dtex polyurethane elastic fiber as the core thread and 22 dtex/20 filament nylon 66 false twisted crimp finished yarn as the sheath thread, with a polyurethane elastic fiber draft of 2.5 and 900 T/m twisting, and then laying 6 single covering yarns having 22 dtex thermal-consolidating elastic fibers ("ROICA SF", trade name of Asahi Kasei Corp.) as the core thread and 33 dtex/12 filament soluble fibers ("BELPURE", trade name of KB Seiren, Ltd.) as the sheath thread, with a polyurethane elastic fiber draft of 2.5 and 800 T/m twisting. The results of performance evaluation for the obtained woven fabric are shown in Table 2.

TABLE 1

| | | Example 1 | Example 2 | Example 3 | Example 4 | Example 5 | Example 6 | Example 7 |
|---|---|---|---|---|---|---|---|---|
| Woven fabric weave | Proportion of intersections in specific regions | 6.25% | 2.04% | 0.23% | 0.16% | 0.049% | 25.0% | 44.4% |
| | Number of warp B thread/weft B thread intersections | 36 | 36 | 1600 | 2500 | 7744 | 1 | 1 |
| | Arrangement of A threads (number of continuous) | 2 | 1 | 2 | 2 | 2 | 1 | 2 |
| Covering conditions for non-elastic fibers and polyurethane elastic yarn | Covering draft | 2.5 | 2.5 | 2.3 | 2.5 | 2.5 | 2.5 | 2.5 |
| | Sheath thread fineness (dtex) | 22 | 22 | 22 | 44 | 22 | 33 | 33 |
| | Number of twists (T/M) | 900 | 900 | 800 | 700 | 900 | 800 | 800 |
| | Twist coefficient | 42 | 42 | 38 | 46 | 42 | 46 | 46 |
| Performance evaluation | Weavability | VG | VG | VG | G | VG | VG | VG |
| | Wash fraying resistance | Grade 5 | Grade 4-5 | Grade 4 | Grade 3-4 | Grade 3 | Grade 5 | Grade 5 |
| | Stretch factor in weft direction (%) | 28.3 | 30.1 | 27.7 | 28.7 | 29.1 | 31.1 | 35.4 |
| | Stretch recovery rate in warp direction (%) | 89.1 | 93.7 | 85.5 | 82.1 | 96.1 | 86.9 | 94.0 |
| | Stretch recovery rate in weft direction (%) | 82.5 | 84.4 | 83.9 | 86.3 | 88.1 | 84.8 | 91.9 |
| | Feel | G | G | G | G | G | G | Δ |

TABLE 1-continued

| | | Example 8 | Example 9 | Example 10 |
|---|---|---|---|---|
| Woven fabric weave | Proportion of intersections in specific regions | 6.25% | 6.25% | 11.1% |
| | Number of warp B thread/weft B thread intersections | 36 | 36 | 36 |
| | Arrangement of A threads (number of continuous) | 2 | 2 | 3 |
| Covering conditions for non-elastic fibers and polyurethane elastic yarn | Covering draft | 2.5 | 2.5 | 2.5 |
| | Sheath thread fineness (dtex) | 22 | 22 | 22 |
| | Number of twists (T/M) | 500 | 1200 | 900 |
| | Twist coefficient | 23 | 56 | 42 |
| Performance evaluation | Weavability | F | VG | VG |
| | Wash fraying resistance | Grade 5 | Grade 3 | Grade 4-5 |
| | Stretch factor in weft direction (%) | 27.9 | 27.9 | 25.1 |
| | Stretch recovery rate in warp direction (%) | 94.1 | 94.1 | 84.1 |
| | Stretch recovery rate in weft direction (%) | 88.4 | 88.4 | 82.3 |
| | Feel | G | G | G |

TABLE 2

| | | Example 11 | Example 12 | Example 13 | Example 14 | Example 15 | Example 16 | Comp. Example 1 |
|---|---|---|---|---|---|---|---|---|
| Woven fabric weave | Proportion of intersections in specific regions | 11.1% | 6.25% | 6.25% | 6.25% | 6.25% | 6.25% | 0.0096% |
| | Number of warp B thread/weft B thread intersections | 100 | 36 | 36 | 36 | 36 | 36 | 10201 |
| | Arrangement of A threads (number of continuous) | 5 | 2 | 2 | 2 | 2 | 2 | 2 |
| Covering conditions for non-elastic fibers and polyurethane elastic yarn | Covering draft | 2.5 | — | 2.5 | 2.5 | 2.5 | — | 2.5 |
| | Sheath thread fineness (dtex) | 22 | 22 | 22 | 22 | 22 | — | 22 |
| | Number of twists (T/M) | 900 | — | 900 | 1000 | 900 | — | 900 |
| | Twist coefficient | 42 | — | 42 | 47 | 42 | — | 42 |
| Performance evaluation | Weavability | VG | F | F | F | VG | G | VG |
| | Wash fraying resistance | Grade 4 | Grade 3 | Grade 3 | Grade 4-5 | Grade 5 | Grade 3 | Grade 2 |
| | Stretch factor in weft direction (%) | 26.4 | 28.3 | 26.4 | 30.1 | 27.5 | 13.4 | 27.6 |
| | Stretch recovery rate in warp direction (%) | 83.9 | 92.3 | 89.3 | 86.9 | 86.7 | 69.7 | 85.2 |
| | Stretch recovery rate in weft direction (%) | 83.3 | 87.5 | 82.8 | 82.6 | 82.9 | 55.2 | 86.4 |
| | Feel | G | G | G | G | G | G | G |

| | | Comp. Example 2 | Comp. Example 3 | Comp. Example 4 |
|---|---|---|---|---|
| Woven fabric weave | Proportion of intersections in specific regions | 0.017% | 0% | 56% |
| | Number of warp B thread/weft B thread intersections | 5625 | — | 4 |
| | Arrangement of A threads (number of continuous) | 0 | — | 6 |
| Covering conditions for non-elastic fibers and polyurethane elastic yarn | Covering draft | 2.5 | — | 2.5 |
| | Sheath thread fineness (dtex) | 22 | — | 22 |
| | Number of twists (T/M) | 1000 | — | 900 |
| | Twist coefficient | 47 | — | 42 |
| Performance evaluation | Weavability | VG | VG | G |
| | Wash fraying resistance | Grade 2-3 | Grade 1 | Grade 5 |
| | Stretch factor in weft direction (%) | 29.9 | 3.7 | 28.3 |
| | Stretch recovery rate in warp direction (%) | 88.1 | 74.9 | 89.1 |
| | Stretch recovery rate in weft direction (%) | 82.8 | 67.2 | 82.5 |
| | Feel | G | G | P |

As shown in Tables 1 and 2, the woven fabrics of Examples 1 to 16 all had suitable stretch properties and excellent fraying resistance.

INDUSTRIAL APPLICABILITY

Since the woven fabric of the invention has a suitable stretch property and excellent fraying resistance it can be used to obtain fiber products, including clothing, without fraying on the fabric edges even with repeated washing and wearing, and with a freely cuttable specification that does not require edge processing.

The invention claimed is:

1. A woven fabric composed of polyurethane elastic yarn bare threads (A threads) and non-elastic yarn or composite yarn comprising non-elastic yarn and polyurethane elastic yarn (B threads), wherein specific regions where both the warp yarn and weft yarn are A threads are present at the intersections between the warp yarn and weft yarn, the warp yarn and weft yarn being bonded or melt bonded at the specific regions, and in a weave repeat of the woven fabric, the proportion of the number of intersections between A threads of the warp yarn and weft yarn in the specific regions with respect to the total number of intersections between warp yarn and weft yarn is 0.02% to 25%.

2. The woven fabric according to claim 1, wherein the number of intersections between warp B threads and weft B threads in a region delineated by the four intersections between two warp A threads adjacent in the weft direction sandwiching a warp B thread, and two weft A threads adjacent in the warp direction sandwiching a weft B thread, is 10,000 or less.

3. The woven fabric according to claim 2, wherein the warp A threads in the weft direction and/or the weft A threads in the warp direction are present with at least two or more in continuity.

4. The woven fabric according to claim 2, wherein the composite yarn comprising non-elastic yarn and polyurethane elastic yarn (warp B threads and weft B threads) is a single covering yarn with polyurethane elastic fiber as the core thread and non-elastic yarn as the sheath thread, and with a covering draft of 1.0 to 4.0 and a twist coefficient K calculated from the following formula (1):

$$K=T/\sqrt{(10{,}000/D)} \quad (1)$$

{where T is the number of turns of the sheath thread wrapped around 1 meter of core thread during processing (T/m) and D is the non-elastic yarn fineness (dtex)} of 18 to 85.

5. A fiber product containing a woven fabric according to claim 2.

6. The woven fabric according to claim 1, wherein the warp A threads in the weft direction and/or the weft A threads in the warp direction are present with at least two or more in continuity.

7. The woven fabric according to claim 6, wherein the composite yarn comprising non-elastic yarn and polyurethane elastic yarn (warp B threads and weft B threads) is a single covering yarn with polyurethane elastic fiber as the core thread and non-elastic yarn as the sheath thread, and with a covering draft of 1.0 to 4.0 and a twist coefficient K calculated from the following formula (1):

$$K=T/\sqrt{(10{,}000/D)} \quad (1)$$

{where T is the number of turns of the sheath thread wrapped around 1 meter of core thread during processing (T/m) and D is the non-elastic yarn fineness (dtex)} of 18 to 85.

8. A fiber product containing a woven fabric according to claim 6.

9. The woven fabric according to claim 1, wherein the composite yarn comprising non-elastic yarn and polyurethane elastic yarn (warp B threads and weft B threads) is a single covering yarn with polyurethane elastic fiber as the core thread and non-elastic yarn as the sheath thread, and with a covering draft of 1.0 to 4.0 and a twist coefficient K calculated from the following formula (1):

$$K=T/\sqrt{(10{,}000/D)} \quad (1)$$

{where T is the number of turns of the sheath thread wrapped around 1 meter of core thread during processing (T/m) and D is the non-elastic yarn fineness (dtex)} of 18 to 85.

10. A fiber product containing a woven fabric according to any claim 9.

11. A fiber product containing a woven fabric according to claim 1.

12. The fiber product according to claim 11, which has a freely cuttable specification.

13. The fiber product according to claim 12, which is an article of clothing.

14. The fiber product according to claim 11, which is an article of clothing.

* * * * *